United States Patent [19]

Lacombe et al.

[11] Patent Number: 4,517,780

[45] Date of Patent: May 21, 1985

[54] INSULATED WALL UNIT CONSTRUCTION

[76] Inventors: Gérard A. Lacombe, 199 O'Brien, Gatineau, Quebec, Canada, J8P 2Y5; Léopold Bonicalzi, 200 Cité des Jeunes, Hull, Quebec, Canada, J8Y 6M1

[21] Appl. No.: 473,252

[22] Filed: Mar. 8, 1983

[30] Foreign Application Priority Data

Feb. 7, 1983 [CA] Canada ..... 421009

[51] Int. Cl.[3] ..... E04B 1/10

[52] U.S. Cl. ..... 52/233; 52/586; 52/562; 52/426

[58] Field of Search ..... 52/586, 428, 427, 426, 52/233, 568, 562, 284, 410

[56] References Cited

U.S. PATENT DOCUMENTS

| | | | |
|---|---|---|---|
| 994,027 | 5/1911 | O'Beirne | 52/568 |
| 1,345,156 | 6/1920 | Flynn | 52/426 |
| 1,768,547 | 7/1930 | Englund . | |
| 1,831,088 | 11/1931 | Barr | 52/427 |
| 2,400,266 | 5/1946 | Soffer . | |
| 2,480,612 | 8/1949 | Sherman | 52/562 |
| 2,563,703 | 8/1951 | Bonney . | |
| 2,669,861 | 2/1954 | Clutter | 52/426 |
| 2,849,759 | 9/1958 | Burdette | 52/586 |
| 3,383,817 | 5/1968 | Gregori | 52/426 |
| 3,440,784 | 4/1969 | Onjukka . | |
| 3,460,301 | 8/1969 | Davis . | |
| 3,490,187 | 1/1970 | Stauffer | 52/562 |
| 3,552,079 | 1/1971 | Mortensen . | |
| 3,742,665 | 7/1973 | Henry et al. . | |
| 4,089,144 | 5/1978 | Astl | 52/568 |
| 4,147,000 | 4/1979 | Lewandowski | 52/233 |
| 4,163,349 | 8/1979 | Smith | 52/586 |

FOREIGN PATENT DOCUMENTS

| | | | |
|---|---|---|---|
| 248527 | 9/1959 | Australia | 52/410 |

*Primary Examiner*—Henry E. Raduazo

*Attorney, Agent, or Firm*—Robic, Robic & Associates

[57] ABSTRACT

A structural log-like member for use in constructing walls, having an outer wooden wall and an inner wooden wall. Wooden spacer members connect the inner and outer walls together in spaced-apart parallel fashion. The spaces between the walls and spacer members can be filled with an insulation material. In use, the structural members can be stacked one on top of the other to form a wall.

7 Claims, 5 Drawing Figures

INSULATED WALL UNIT CONSTRUCTION

The present invention relates to a structural log-like member.

The invention also relates to a wall constructed from structural log-like members according to the invention.

Log houses made from logs piled one on top of the other are well known. Log wall construction has several problems however. The wall is not always reliably stable in the horizontal direction and adjacent logs can move or shift laterally with respect to each other between their ends unless vertical joining means between adjacent logs are provided. The log wall also is not reliably stable in the vertical direction since the logs contact each other in an imperfect manner and vertical loading is often highly indeterminate. Log walls are also very poor insulators.

The object of the present invention is to provide a structural log-like member, which when joined with other log-like members, provides a wall having improved stability, improved structural properties and substantially improved insulation properties as compared to conventional log walls.

In accordance with the present invention, a structural log-like member is provided which can be stacked one on top of the other in a uniform, stable manner. The structural members bear on each other along their outer and inner longitudinal edges making them very stable against lateral forces. In addition, fastening means join the members together at their inner and outer sides making the wall very resistent to bending forces about a horizontal axis. The contact between the members is uniform, thus making uniform the transfer of compressive forces. The structural members are hollow and they can be filled with an insulation material to improve its insulation properties.

Each structural member is made from two relatively thin, wooden wall members joined by wooden spacer members. The spacer members are spaced apart longitudinally of the wall members and are substantially equal in height to the wall members. Each spacer member preferably comprise a pair of spaced-apart, parallel end posts and two side panels joining the end posts together. The space defined by the posts and side panels can also be filled with insulation.

The ends of each end post can be joined by nailing plates, or other suitable fastener means, to the top and bottom edges of the adjacent wall member. This construction advantageously provides stiffness against twisting of the structural member.

Preferably, the structural members are stacked with the spaced members aligned. Thus, compressive loading in the wall is transferred in part through the aligned end posts in the direction of the grain, thus making the structure stronger.

More particularly, the present invention basically proposes a structural log-like member for use in constructing walls, which comprises a relatively, thin wooden outer wall member and a relatively thin wooden inner wall member. The two wall members are spaced from each other and are parallel. Wooden spacer members are located between the wall members and are spaced apart longitudinally of the wall members. The spacer members are substantially equal in height to the wall members and means are provided for joining the spacer members to the wall members.

The invention also proposes a wall composed of structural log-like members according to the invention, stacked one on top of the other.

A preferred embodiment of the invention will now be described in detail having reference to the accompanying drawings in which.

Figure 1:
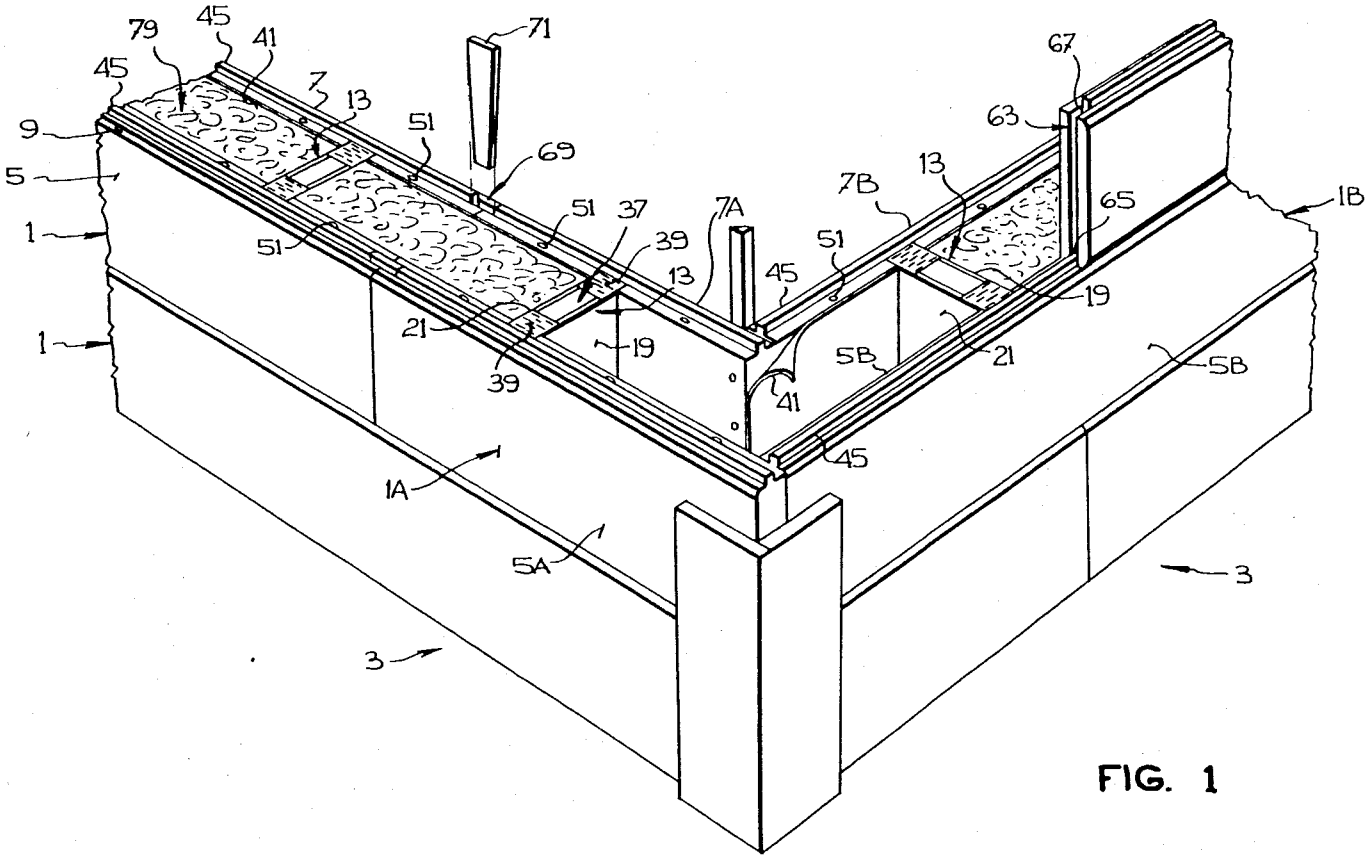
FIG. 1 is a perspective view of a corner of a building wall according to the invention.
Figure 2:
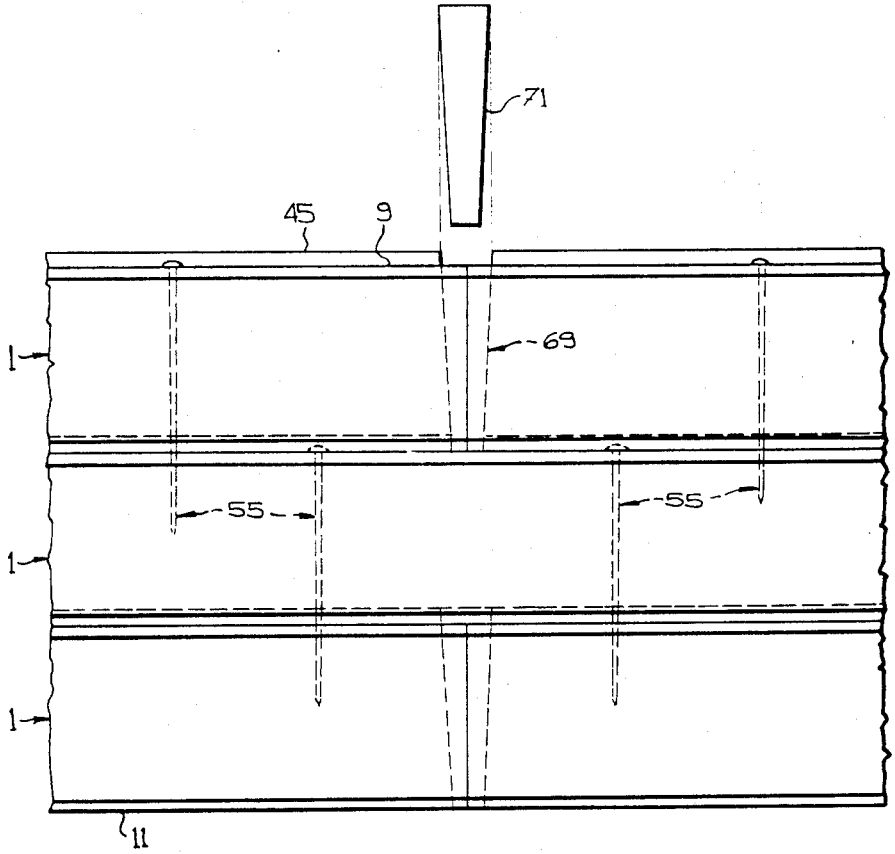
FIG. 2 is a side view of a portion of the building wall of FIG. 1.

The structural log-like members 1 of the present invention are used to construct building walls 3 as shown in FIGS. 1 and 2. The structural members 1 are stacked one on top of the other to form the walls 3, with each member 1 being joined to the member 1 beneath it by suitable fastening means as will be described.

Figure 3:
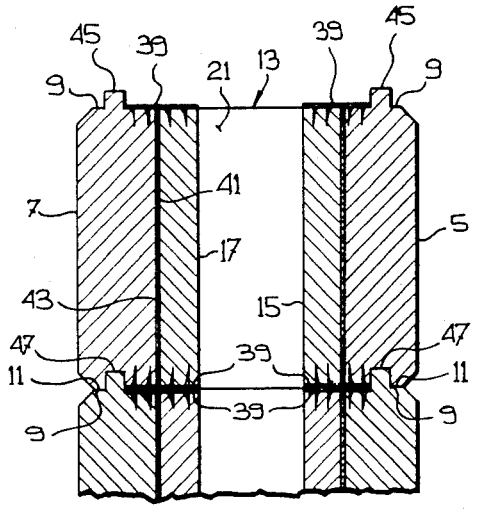
FIG. 3 is a cross-section view of a structural log-like member used to construct the wall shown in FIGS. 1 and 2.

Each structural member 1 has an outer wall member 5 and an inner wall member 7 as shown in FIGS. 1 and 3. Both wall members 5 and 7 preferably comprise a relatively long, thin wooden plank or board having a top edge 9 and a parallel bottom edge 11. The wall members 5 and 7 are spaced apart and parallel to each other.

Figure 4:
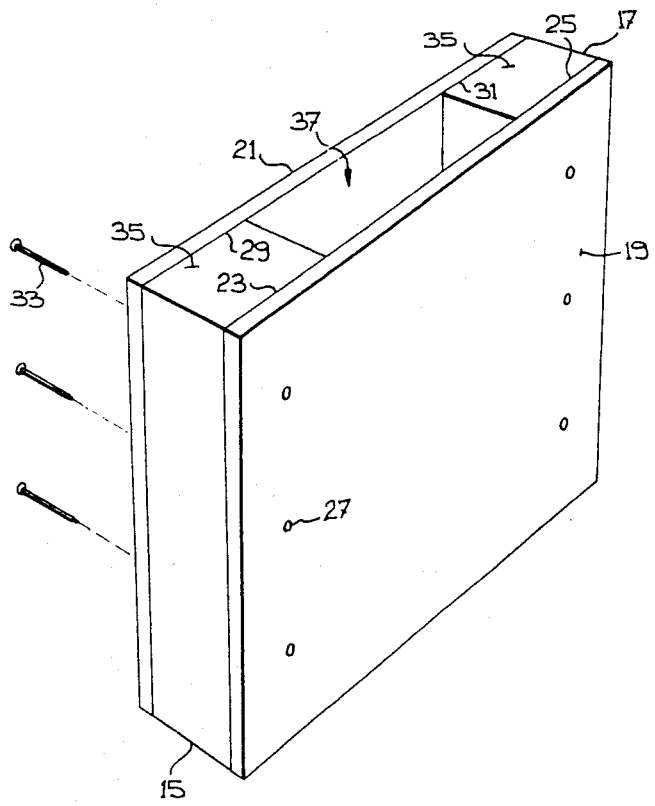
FIG. 4 is a perspective view of a spacer member.

Wooden spacer members 13 are located between the wall members 5 and 7. These spacer members 13 are spaced-apart longitudinally of the wall members 5 and 7. Each spacer member 13 as shown in FIG. 4, preferably comprises a pair of vertical end posts 15 and 17. The end posts 15 and 17 have a square or rectangular cross-section and are joined together by thin side panels 19 and 21. One side panel 19 overlies the sides 23 and 25 of the posts 15 and 17 respectively, and is joined to these sides 23 and 25 by suitable fastening means 27. The other side panel 21 overlies the opposite sides 29 and 31 of the posts 15 and 17 respectively and is joined to these sides 29 and 31 by fastening means 33. The side panels 19 and 21 are parallel to each other and hold the posts 15 and 17 in parallel spaced-apart relation. The end posts 15 and 17 are preferably made of blocks of wood with the grain running vertically between the ends 35 of the posts. The side panels 19 and 21 are preferably made of pieces of plywood or other wood panels. The fastening means 27 and 33 may consist of nails or wood staples. The spacer members 13 have a box-beam type of construction and the interior space 37 of the spacer members 13 can be filled with an insulation material such as glass wool.

The spacer members 13 are mounted snugly between the wall members 5 and 7 and are fixed to the wall members 5 and 7 by suitable fastening means 39. The fastening means 39 are preferably made of small nail plates also known as too the at truss plates, which overlie each end 35 of each post 15 and 17, and a portion of the top and bottom edges 9 and 11 of wall members 5 and 7.

The use of individual prefabricated spacer members 13 connected between the wall members 5 and 7 by means of toothed truss plates 39, provide resistance to distortions that would make the cross-section change from a rectangle to a parallelogram. This mode of resistance provides the wall with greater buckling resistance than a type of prefabricated wall which is effectively a pile of rectangular tubes filled with insulation. Indeed, the latter type of wall has to rely on overall buckling resistance in a manner similar to that in traditional log construction.

When erecting a wall, the spacer members 13 can advantageously be lined up with each other. This ensures that vertical stress be largely transmitted through these spacer member to the foundation support. Even if they do not all line up, the majority of the stress is borned by end grain bearing. Where it is borne by side grain bearing, where the stub line may shift and stresses are transferred horizontally within the wall, only a short height of wall is affected. The important advantage of this design is that compressive strain caused by dead and live loadings in a direction perpendicular to the grain of wood is held to a minimum, just as it is in conventional wood frame construction. Tolerances around windows and doors do not have to be made excessively large to account for settling of the outside walls as is normally necessary in log house construction. It also means that interior partitions can be of standard frame construction and can be nailed directly to the outside walls because they will have similar compressibility. Further, it means that the exterior walls will not shrink relative to the inside walls any more than conventional light-framed construction and sloped floors and other problems associated with relative motion between elements of the house (such as between ceilings and walls) are avoided.

A vapour barrier 41 can be located adjacent the inner face 43 of the inner wall member 7 before joining the outer and inner wall members 5 and 7 and the spacer members 13 together to form the structural member 1.

Each structural member 1 can be provided with interlocking means for use in mounting it on, and connecting it to, another log-like member 1. As shown in FIGS. 1 and 3, these interlocking means may comprise tongue 45 provided on each wall member 5 and 7 along the center of its top edge 9, and a groove 47 provided on each wall member 5 and 7 along the center of its bottom edge 11. In this particular case, each structural member 1 sits on the structural member 1 beneath it with the grooves 47 in its wall members receiving the tongues 45 of the wall members of the structural member beneath it to securely position the upper structural member against transverse movement relative to the lower structural member.

Advantageously, a rubber seal (not shown) can be inserted in the bottom of each groove 47 prior to positioning the structural members one above the other, in order to improve the insulation property of the while assembly.

Figure 5:
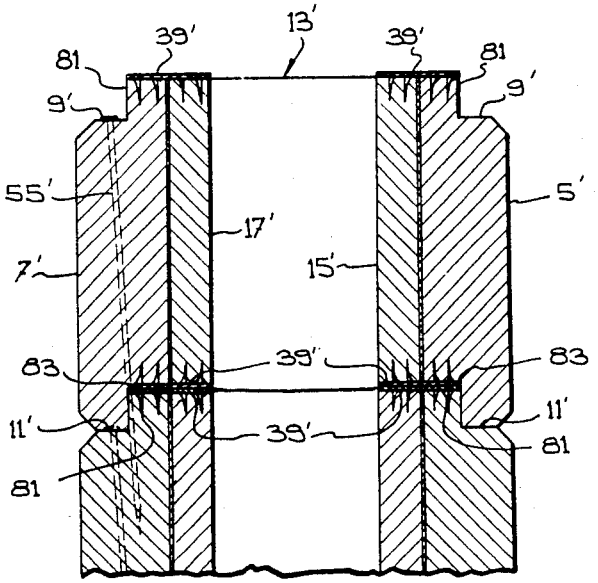
FIG. 5 is a cross-section view similar to the one of FIG. 3, showing another possible embodiment of structural log-like member.

As shown in FIG. 5, the interlocking means for mounting each structural member on, and connecting it to, another log-like member 1' may also comprise a lateral projection 81 integrally extending the top edge 9 each wall member 5 and 7 adjacent the inner lateral surface thereof, and a lateral recess 83 provided in the bottom edge 11 of each wall member 5 and 7 adjacent the outer lateral surface thereof. In this case, each structural member 1' sits on the structural member 1' beneath it with the lateral projections 81 of its wall members matching with the lateral recesses 83 opposite thereto of the wall members of the structural member beneath it to securely position the upper structural member against transverse movement relative to the lower one. In FIG. 5, the structural elements of the members 1' identical to those of the members 1 of FIG. 3 have been identified with the same reference numerals with a prime <<'>>.

A plurality of vertical holes 51 are provided in each wall member 5 and 7. The holes 51 are spaced apart longitudinally, and extend down from the top edge 9 from a position adjacent the tongue 45. A long nail or spike 55 can be driven down through each hole 51 and into the wall member beneath to securely lock the wall members together.

By way of examples, the inner and outer wall members can be piked to each other with 10-inch spikes at a maximum spacing of 48 inches in each course. This is equivalent to a spike spacing of two feet or less around the entire perimeter of the house for each course. The fact that the spikes 55 are located in the wall members, advantageously provides the wall with a certain degree of bending resistance about any horizontal axis, as would be produced in a free standing wall carrying a heavy compressive loading. This provides the wall a much greater degree of buckling resistance than if this connection were provided only in the middle of the wall, as it is in conventional log construction.

Each end 61 of each wall member 5 and 7 in a structural member 1 has a vertical central groove 63 therein as shown in FIG. 1. The groove 63 is not as deep at its bottom end 65 as at its top end 67 so that the groove 63 tapers. When one end of one structural member is abutted against the end of another structural member in the same row, the end grooves 63 in each wall member of one structural member are aligned with the grooves 63 in the wall members in the other structural member to form tapered slots 69. Pegs 71, shaped and tapered to match the slots 69, are driven into the slots 69 to help secure the structural members together.

Corner structural members 1A in one wall are formed by cutting a piece off a regular structural member of required length, and then shortening the inner wall member 7A to provide clearance for the outer wall member 5B of the other corner structural member 1B in the other wall. The other corner structural member 1B in the other wall is also formed by cutting a piece off a regular structural member of a length to fit between the inner side 75 of the outer wall member 5A and the inner side 77 of the inner wall member 7A in the one corner structural member 1A in the one wall, and the end of the last full structural member in the other wall (not shown). The overlapping ends of the wall members 5A, 7A of the one corner member 1A are nailed to the overlapped ends of the wall members 5B, 7B of the other corner member 1B.

As each row of the log members is erected, the space 79 between the wall members 5, 7 in each log member can be filled with an insulation material such as glass wool. As there is no horizontal partition between the rows of log members, the insulation material may extend continuously the whole height of the erected wall, thus providing excellent insulation property to the wall.

The embodiments of the invention in which an exclusive property or privilege is claimed are defined as follows:

1. A structural log-like member for use in constructing walls, said member comprising:

a relatively thin, wooden outer wall member having parallel top and bottom edges;

a relatively thin, wooden inner wall member having parallel top and bottom edges;

said outer and inner wall members being spaced from each other and parallel to each other, the top edge of each wall member having means projecting upwardly therefrom, and the bottom edge of each wall member having a groove or recess extending inwardly, at least one end of each wall member having a vertical slot therein which tapers from a deep end at the top of the wall member to a shallow end at the bottom of the wall member;

wooden spacer members located between the outer and inner wall members and spaced apart longitudinally of said wall members, each of said spacer members being substantially equal in height to the wall members and comprising two wooden spaced-apart end posts, said end posts being parallel to each other, and two side panels extending between the sides of the end posts to connect the end posts together;

means for joining the spacer members to the outer and inner wall members, said means comprising four nailing plates, each nailing plate extending across one end of one of the posts and a portion of one of the edges of one of the wall members; and an insulation material located between the inner and outer wall members and between the posts and the side panels of each spacer member.

2. A structural member as claimed in claim 1 further comprising a vapour barrier mounted on the inner face of the inner wall member.

3. A structural member as claimed in claim 1 including longitudinally spaced apart fastening guide holes in each wall member, each guide hole extending through the wall member between its top and bottom edges.

4. A wall composed of structural log-like members stacked one on top of the other, each structural member comprising:

a relatively thin wooden outer wall member having parallel top and bottom edges;

a relatively thin wooden inner wall member having parallel top and bottom edges;

said outer and inner wall members being spaced from each other and parallel to each other;

wooden spacer members located between the outer and inner wall members and spaced apart longitudinally of the wall members, each of said spacer members being substantially equal in height to the wall members and comprising two wooden spaced-apart end posts, said end posts being parallel to each other, and two side panels extending between the sides of the end posts to connect the end posts together, each spacer member in each structural member overlying a spacer member in the structural member beneath;

means for joining the spacer members to the wall members;

longitudinally spaced apart fastening guide holes in each wall member of each structural member, each guide hole extending through the wall member between its top and bottom edges;

spike-like fasteners driven through each hole and part way into a wall member of the structural member beneath;

wherein:

the bottom edges of the wall members of each structural member rest on the top edges of the wall members of the structural member beneath it, and interlocking means connect each bottom edge to each top edge; and an insulation material is located between the inner and outer wall members and between the posts and side panels of each spacer member, said insulation material extending continuously the entire height of the wall.

5. A wall as claimed in claim 4, further comprising a vapour barrier mounted on the inner faces of the inner wall members of the structural log-like members.

6. A wall as claimed in claim 4, wherein said means for joining the spacer members to the wall members of each log-like member are nailing plates.

7. A wall composed of structural log-like members stacked one on top of the other, each structural member comprising:

a relatively thin wooden outer wall member having parallel top and bottom edges;

a relatively thin wooden inner wall member having parallel top and bottom edges;

said outer and inner wall members being spaced from each other and parallel to each other;

wooden spacer members located between the outer and inner wall members and spaced apart longitudinally of the wall members, each of said spacer members being substantially equal in height to the wall members and overlying a spacer member in the structural member beneath;

nailing plates for joining the spacer members to the wall members;

longitudinally spaced apart fastening guide holes in each wall member of each structural member, each guide hole extending through the wall member between its top and bottom edges;

spike-like fasteners driven through each hole and part way into a wall member of the structural member beneath;

wherein:

the bottom edges of the wall members of each structural member rest on the top edges of the wall members of the structural member beneath it, interlocking means connect each bottom edge to each top edge;

an insulation material is located between the inner and outer wall members, said insulation material extending continuously the entire height of the wall, and a vapour barrier is mounted on the inner faces of the inner wall members of the structural log-like members.

* * * * *